US005358778A

United States Patent [19]

Nagashima et al.

[11] Patent Number: 5,358,778

[45] Date of Patent: Oct. 25, 1994

[54] HEAT TRANSFER SHEET

[75] Inventors: Kousaku Nagashima, Kitamoto; Shin-ichi Namiki, Tokyo; Kiyoshi Sakai, Kumagaya, all of Japan

[73] Assignee: Lintec Corporation, Tokyo, Japan

[21] Appl. No.: 80,104

[22] Filed: Jun. 23, 1993

[30] Foreign Application Priority Data

Jun. 26, 1992 [JP] Japan ..... 4-169509

[51] Int. Cl.[5] ..... B41M 5/26

[52] U.S. Cl. ..... 428/212; 428/195; 428/913; 428/914

[58] Field of Search ..... 428/200, 484, 913, 914, 428/537.5, 212, 195

[56] References Cited

U.S. PATENT DOCUMENTS 4,863,781 9/1989 Konzer ..... 428/200

FOREIGN PATENT DOCUMENTS 0439049 7/1991 European Pat. Off. ..... 428/200
0453579 10/1991 European Pat. Off. .
0492571 7/1992 European Pat. Off. ..... 428/200

OTHER PUBLICATIONS

Japanese Patent Abstract No. 60-56593, vol. 9, No. 191 (M-402) [1914], Aug. 7, 1985.

*Primary Examiner*—Pamela R. Schwartz
*Attorney, Agent, or Firm*—Finnegan, Henderson, Farabow, Garrett & Dunner

[57] ABSTRACT

A first substrate and a second substrate are peelably integrated to make a base paper. A thermally transferable layer is provided on the second substrate, if desired, via a releasing layer to make a heat transfer sheet. At least the first substrate is made of a material having air permeability and surface roughness.

6 Claims, 7 Drawing Sheets

HEAT TRANSFER SHEET

BACKGROUND OF THE INVENTION

1. Field of the Invention

The present invention relates to a heat transfer sheet for transferring letters, symbols, designs, patterns or the like to a substance to which any of them is to be transferred (hereinafter referred to as "transfer substance").

2. Description of the Prior Art

A heat transfer sheet is used to transfer letters, symbols or designs to a transfer substance for the purpose of display and/or decoration. The heat transfer sheet has a sheet-like substrate such as paper or a plastic film, a thermally transferable layer being arranged on the substrate and a releasing layer for intervening between the substrate and the thermally transferable layer. Alternately, the heat transfer sheet has a sublimable transfer layer being arranged on the substrate. When letters, symbols or designs are transferred on a transfer substance by using the heat transfer sheet, some methods are available. One of the examples has the steps of forming desired letters, symbols or designs on the releasing layer on the substrate by a printing method such as silk screen printing, gravure printing or offset printing, and transferring them to a transfer substance. Another example has the steps of applying the thermally transferable layer onto the whole surface of the substrate, cutting out desired letters, symbols or designs from the resulting assembly, and transferring the cut-out pattern to a transfer substance.

The heat transfer sheet with the thermally transferable layer on the whole surface of the substrate has the advantage that desired letters, symbols or designs can be formed in a desired amount at a desired time. A computer-controlled automatic cutting machine is used for cutting out letters, symbols or designs. Some methods are available for this purpose. One of the examples has the steps of forming notches extending from the thermally transferable layer toward the substrate of the heat transfer sheet, separating letters, symbols or designs individually from the heat transfer sheet, and rearranging them. Another example has the steps of making notches only in the thermally transferable layer, and removing the unnecessary portions of the thermally transferable layer. In the former method, it is difficult to rearrange the individually separated letters, symbols or designs. Thus, the latter method involving notches only in the thermally transferable layer is more advantageous.

The latter method, however, poses the following problem: In a heat transfer sheet having a thermally transferable layer on a substrate via a releasing layer, if the thermally transferable layer is thick, its unnecessary portions are easy to peel off; if the thermally transferable layer is thin, its unnecessary portions are difficult or impossible to peel off.

When letters, symbols, designs, etc. are to be transferred using a heat transfer sheet to a large-area transfer substance for the purpose of display or decoration, particularly in the form of an advertisement or a billboard, there is generally used a heat transfer machine called the Heat Vacuum Applicator (H.V.A.). The H.V.A. has a transfer table, a framed rubber sheet covering an upper surface of the transfer table, and a heating portion covering the rubber sheet. The space defined by the upper surface of the transfer table and the framed rubber sheet is deaerated by a vacuum pump to become a vacuum area. Materials necessary for transfer, such as a transfer substance and a heat transfer sheet, are placed between the transfer table and the framed rubber sheet prior to the deaeration step. Deaeration for forming the vacuum area may be performed from the transfer table side, and/or from the frame side of the framed rubber sheet. The heating device generally includes a row of incandescent lamps.

The heat transfer using the H.V.A. is advantageous because it can easily perform on materials with a large area, especially materials for advertisements or billboards. A method for heat transfer by the H.V.A. has the steps of placing a transfer substance on the upper surface of the transfer table, laying a heat transfer sheet on the transfer substance so as to face downwardly the thermally transferable layer, and superimposing on the heat transfer sheet a porous material, such as a woven fabric, of a size large enough to cover the whole of the transfer substance and the heat transfer sheet. Then, the framed rubber sheet is laid on the porous material, whereafter the vacuum pump is actuated to form the vacuum area. Within the vacuum area, air is removed from the interface between the transfer substance and the heat transfer sheet, whereby the heat transfer surface of the heat transfer sheet is brought into intimate contact with the surface of the transfer substance, and the contact surfaces are adapted to each other. After the contact surfaces are sufficiently adapted, heat is applied from above the rubber sheet by the heating device, with the vacuum pump being operated, thereby carrying out heat transfer.

As described above, the heat transfer by the H.V.A. requires a porous material, such as a woven fabric, as a third material in addition to the transfer substance and the heat transfer sheet. The porous material is indispensable to promote deaeration from the interface between the transfer substance and the heat transfer sheet within the vacuum area and to cause the contact surfaces of them to be completely contacted and adapted.

Placing the porous material every time a transfer procedure is performed makes operation complicated and decreases the efficiency of operation. The placement of the porous material also causes wrinkles during the deaeration of the vacuum area, thereby impairing transfer.

SUMMARY OF THE INVENTION

Accordingly, an object of the present invention is to provide a heat transfer sheet which is free from the above-described problems, which has excellent heat transfer properties, from which letters, symbols, designs, etc. can be cut out by means of the automatic cutting system, which permits the unnecessary portions of the thermally transferable layer to be easily weeded or removed, and which makes it possible to remove air easily and completely from the interface between a transfer substance and the heat transfer sheet for heat transfer by the H.V.A., without the need to install a porous material.

In the first aspect of the present invention, a heat transfer sheet comprises a first substrate, a second substrate being peelably integrated with the first substrate, and a thermally transferable layer being formed on the second substrate integrated with the first substrate, wherein at least the first substrate is air permeable.

In the second aspect of the present invention, a heat transfer sheet comprises a first substrate, a second substrate being peelably integrated with the first substrate, and a thermally transferable layer being formed on the second substrate integrated with the first substrate, wherein at least the first substrate has a rough surface.

In the third aspect of the present invention, a heat transfer sheet comprises a first substrate, a second substrate being peel ably integrated with the first substrate, and a thermally transferable layer being formed on the second substrate integrated with the first substrate, wherein at least the first substrate is air permeable, and wherein at least the first substrate has a rough surface.

Here, it may further comprise a releasing layer being arranged between the second substrate and the thermally transferable layer, the releasing layer for separating the second substrate from the thermally transferable layer being transferred as information onto a transfer substance.

Sheet-like materials heat resistant enough to withstand the heat applied thereto during heat transfer operations can be used for the first substrate of the heat transfer sheet. Any of these materials is required to have porosity and/or a rough surface so as to be capable of contributing to deaeration as an air permeable material for use in the H.V.A. For a deaerating effect in the H.V.A., importance is attached to air passage through the cross-sections and surface of the porous material used. Thus, the first substrate must have porosity at its cross-sections and/or the roughness of its surface. Concrete examples of its materials are woodfree paper, kraft paper or the like with low air resistance, embossed paper or the like with a rough surface, and crepe paper, nonwoven fabric, woven fabric or the like with low air resistance and a rough surface.

For the second substrate there can be used materials with heat resistance enough high to withstand the heat applied thereto during heat transfer operations. Preferably, these materials should have air permeability as do the materials for the first substrate. Specific examples of such materials are paper such as woodfree paper, kraft paper, crepe paper, embossed paper or nonwoven fabric, porous plastic films, and woven fabric.

Various methods can be used to form the second substrate on the first sheet-like substrate so far as these methods ensure appropriate peeling properties between the first and second substrates. Specifically, the two substrate layers are couched to each other during the paper making process using a paper machine such as a multi-layers cylinder paper machine, a cylinder short-Fourdrinier combination paper machine, a cylinder Fourdrinier combination paper machine or a multi-layers Fourdrinier paper machine. More specifically, a couched sheet is prepared by properly selecting and/or controlling the pulp content, the thicknesses of these two layers, and chemicals to be used in the process for the product ion of each layer so that appropriate peeling properties and porosity (air permeability) are ensured. Alternatively, the first sheet-like substrate is treated with a releasing agent such as silicone resin, long chain alkyl resin, alkyd resin or polyolefin resin, natural wax or synthetic resin and then the second substrate is laminated to the first substrate. Adhesives used for the lamination are those comprising acrylate copolymers and rubbers which may be of a self-curable type, a curable type, a solvent-based type, or an emulsion type. The amount of the adhesive applied ranges from 5 to 100 $g/m^2$, preferably 10 to 50 $g/m^2$, expressed on a solid weight basis. Thus, a laminated sheet is prepared while selecting a proper combination of the releasing agent and the adhesive so that appropriate peeling properties can be obtained between the two layers. In this connection, the releasing agent should be applied onto the first substrate, while the adhesive should be applied onto the second substrate; otherwise, when the unnecessary portions of the thermally transferable layer are weeded or removed together with the second substrate, the adhesive layer on the surface of the first substrate corresponding to the removed portions is exposed, and a transfer substance is brought into contact with the exposed adhesive during transfer, whereby the first substrate and the transfer substance are thermally bonded.

The thermally transferable layer provided on the second substrate has a composition which may vary depending on the applications of the resulting heat transfer sheet and the materials for transfer substances. Examples of the materials for the thermally transferable layer include thermally adherable resins, such as polyester resins, acrylic resins, vinyl chloride resins, and ethylene-vinyl acetate copolymer resins, which may be used alone or in combination. These thermally adherable resins may be mixed with coloring agents such as dyes or pigments, tackifiers, or plasticizers.

When the heat transfer sheet according to the present invention is to be used, notches extending from the thermally transferable layer to the first substrate through the second substrate are formed by cutting along desired letters or designs by the automatic cutting system. Then, unnecessary portions of the thermally transferable layer other than those portions which are to be transferred are weeded or peeled from the first substrate along the aforementioned notches, together with those portions of the second substrate which are just below the unnecessary portions. As a result, only the portions constituting the desired letters or designs are left on the first substrate. The heat transfer sheet having these letter or design portions is superimposed on a transfer substance placed on the transfer table of the H.V.A. such that the thermally transferable layer contacts the transfer substance. Then, the heat transfer sheet is covered with the framed rubber sheet, and the vacuum pump is actuated to produce the vacuum area. When air has completely been removed from within the vacuum area, and the contact surfaces of the transfer substance and the heat transfer sheet have become sufficiently adapted to each other, heat is applied by the heating device for a predetermined period of time. After heating is completed, the vacuum area is restored to atmospheric pressure, and the second substrate having had the thermally transferable layer constituting the letters or designs is peeled off the transfer substance together with the first substrate. The necessary thermally transferable layer making up the letters or designs remains on the transfer substance by heat adhesion, thus giving a desired display or decoration.

In the heat transfer sheet of the present invention, at least the first substrate has a rough surface, so that during vacuum generation using the H.V.A., a tiny gap is formed throughout the entire interface between the framed rubber sheet and the heat transfer sheet, and air is removed uniformly from the entire interface. Thus, no wrinkles are formed on the surface of the heat transfer sheet. With the heat transfer sheet in which at least the first substrate is air permeable, the first substrate itself constitutes a deaeration passageway through which air is removed rapidly and uniformly toward the surroundings of the first substrate. With the heat transfer sheet in which at least the first substrate has both air permeability and surface roughness, the above deaerating effect is performed synergistically.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described in detail below by reference to the accompanying drawings.

EXAMPLE 1

Figure 1:
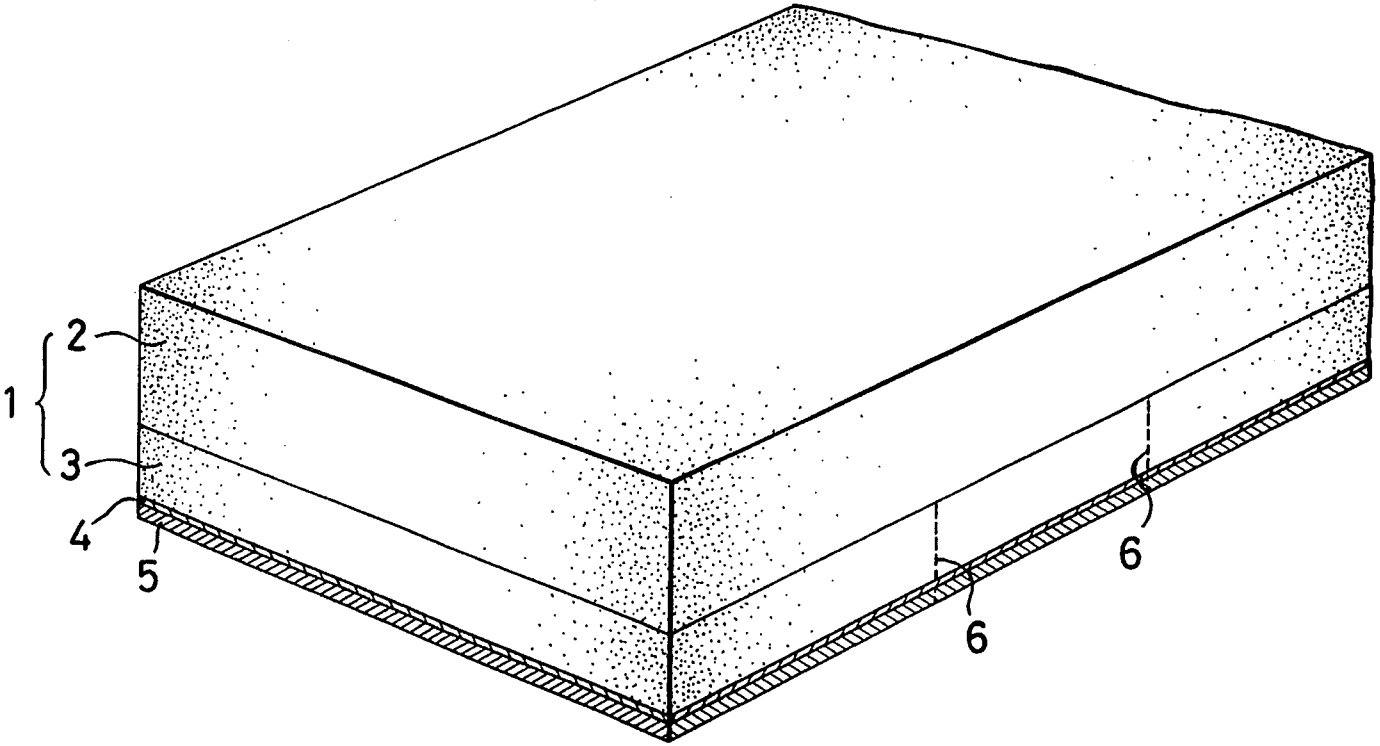
FIG. 1 is a schematic perspective view showing a first embodiment of a heat transfer sheet according to the present invention.

FIG. 1 shows the cross-section of a heat transfer sheet having a thermally transferable layer provided on a couched base paper, as a first embodiment of the present invention.

Figure 2:
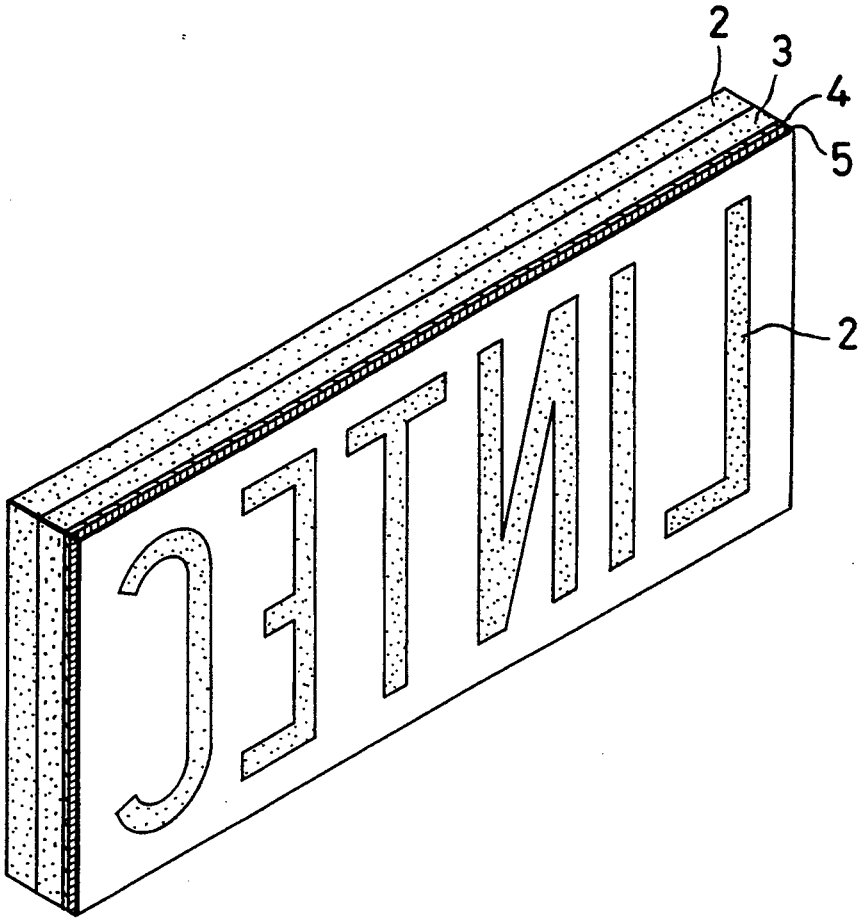
FIG. 2 is a schematic perspective view showing a state in which a second substrate and a thermally transferable layer have been peeled off according to shapes of letters from the heat transfer sheet shown in FIG. 1.

A base paper 1 consisting of a first substrate 2 and a second substrate 3 was obtained by couching two layers each having a basis weight of 40 g/m$^2$ using a multi-layers cylinder paper machine so as to have appropriate peeling properties. The base paper 1 has a basis weight of 80 g/m$^2$, a Stöckigt sizing degree of 20 seconds, and an air resistance of 15 seconds. Each of the first and second substrates 2 and 3 has a smoothness of 10 seconds. An emulsion silicone (KM-768, Shin-Etsu Chemical Co., Ltd. ) was applied onto the second substrate 3 to a dry weight of 1 g/m$^2$ to form a releasing layer 4. A pigmented resin comprising an acrylic resin, a vinyl chloride-vinyl acetate copolymer resin, and a pigment was applied onto the releasing layer 4 to a dry weight of 5 to 10 g/m$^2$ to form a thermally transferable layer 5, thereby completing a heat transfer sheet. The heat transfer sheet was subjected to an action by a grid type automatic cutting machine, whereby notches 6 extending from the thermally transferable layer 5 to the interface between the second substrate 3 and the first substrate 2 were formed along the letters "LINTEC" in a region measuring 1,000 mm×3,000 mm. Then, unnecessary portions of the thermally transferable layer 5 were peeled off together with the corresponding portions of the second substrate 3 along the notches 6 for the letters "LINTEC" (FIG. 2 ). The thermally transferable layer containing the letters was thermally transferred to a non-rigid polyvinyl chloride cloth for tent (Lunashine #100, Teijin Ltd.) in accordance with the aforementioned procedure using the H.V.A. The time required for deaeration was 45 secorods, and the heat transfer conditions were 110° C., 600 mmHg (gauge pressure), and 5 minutes. Notch formation by the automatic cutting machine, the peeling properties of the first substrate 2 and the second substrate 3 during the removal of the unnecessary portions, and the transfer properties of the thermally transferable layer containing the letters were all excellent, and thus a satisfactory transferred pattern was obtained.

EXAMPLE 2

A heat transfer sheet was prepared in the same manner as in Example 1, except that a polyethylene resin was laminate-coated to a thickness of 30 μm as releasing layer 4. The heat transfer sheet was subjected to an operation by a grid type automatic cutting machine in the same way as in Example 1 to make the cut-out letters "LINTEC". The thermally transferable layer containing the letters was thermally transferred to a non-rigid polyvinyl chloride cloth for tent (Lunashine #100) in accordance with the procedure of Example 1 using the H.V.A. In the instant embodiment, deaeration in the H.V.A. was completed in 43 seconds, the pressure reached was 600 mmHg (gauge pressure), and heat was applied at 115° C. for 5 minutes. The transfer properties were satisfactory.

EXAMPLE 3

Figure 3:
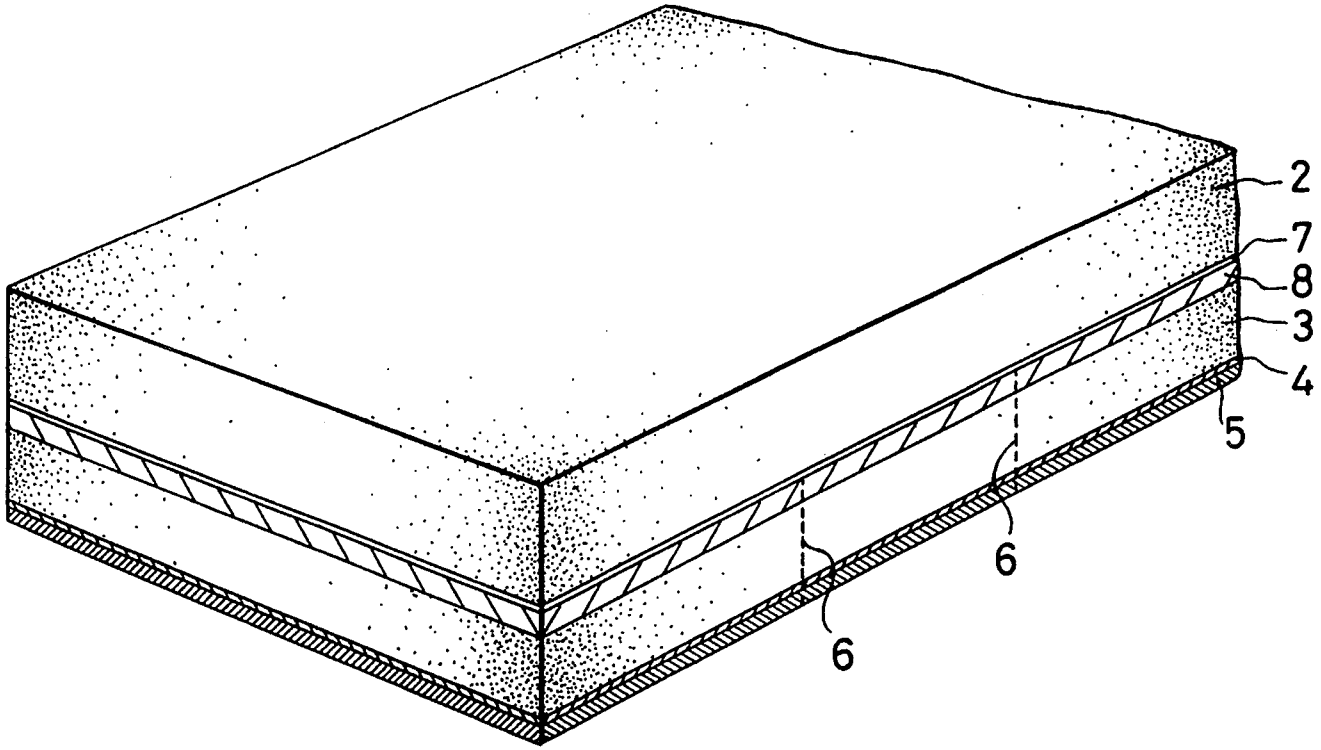
FIG. 3 is a schematic perspective view showing a second embodiment of a heat transfer sheet according to the present invention.

FIG. 3 shows the cross-section of a heat transfer sheet having a thermally transferable layer formed on an laminated base paper, as a second embodiment according to the present invention.

Figure 4:
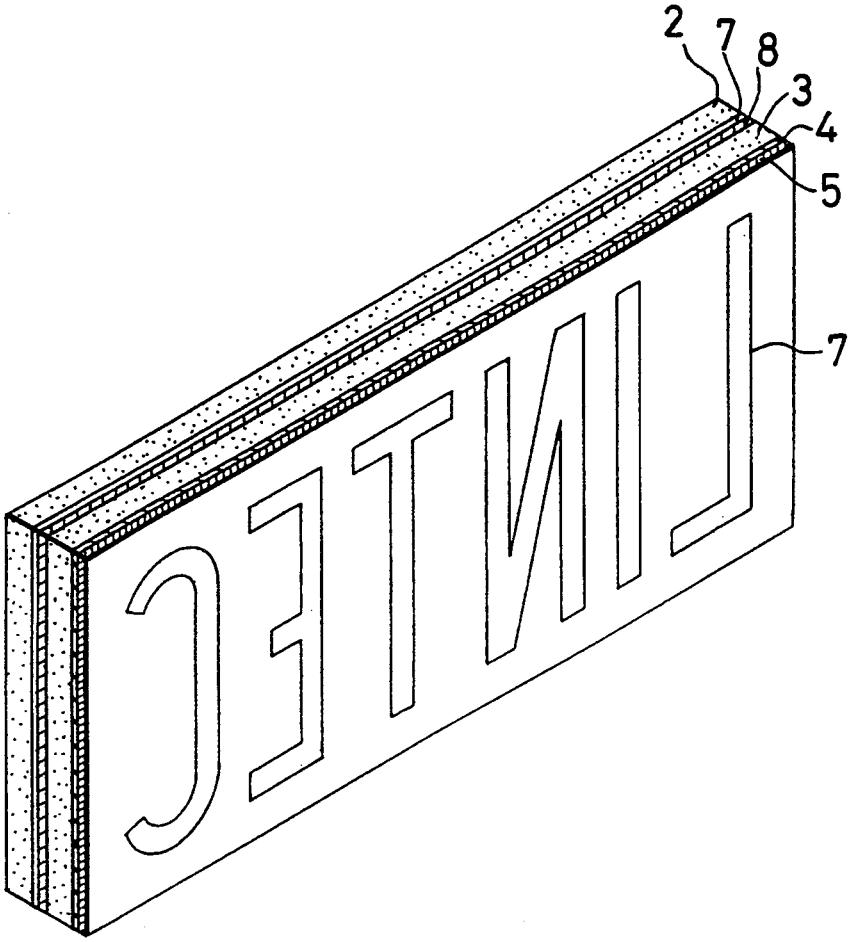
FIG. 4 is a schematic perspective view showing a state in which a second substrate, etc. have been peeled off according to shapes of letters from the heat transfer sheet shown in FIG. 3.

Woodfree paper having a basis weight of 110 g/m$^2$, an air resistance of 15 seconds, and a smoothness of 20 to 25 seconds was used as a first substrate 2. A polyethylene resin was laminate-coated onto the first substrate 2 to a thickness of 17 μm to serve as a barrier layer (not shown). A solvent-based silicone resin (KS-833, Shin-Etsu Chemical Co., Ltd.) was applied onto the polyethylene layer to a solid weight of 0.5 g/m$^2$ to form a peel layer 7. Woodfree paper having a basis weight of 70 g/m$^2$, an air resistance of 25 seconds, and a smoothness of 30 to 40 seconds serving as a second substrate 3 was laminate-coated with a polyethylene resin to a coating thickness of 30 μm to form a releasing layer 4. The same pigmented resin composition as in Example 1 was applied onto the releasing layer 4 to a dry weight of 5 to 10 g/m$^2$ to form a thermally transferable layer 5. The first substrate 2 and the second substrate 3 provided with the thermally transferable layer 5 were laminated using a curable adhesive 8 of an acrylate copolymer (Orivain BPS-4891, Toyo Ink Mfg. Co., Ltd.) to obtain a heat transfer sheet. The heat transfer sheet was subjected to an operation by a grid type automatic cutting machine in the same way as in Example 1 to make the cut-out letters "LINTEC" (FIG. 4). The thermally transferable layer containing the letters was thermally transferred to a non-rigid polyvinyl chloride cloth for tent (Lunashine #100) in the same manner as in Example 1 using the H.V.A. The deaeration time was 43 seconds, the pressure reached was 600 mmHg (gauge pressure), and heat was applied at 110° C. for 5 minutes. The cutting properties, the peeling properties of the unnecessary portions, and the transfer properties were all excellent.

EXAMPLES 4 TO 7

Heat transfer sheets were prepared in the same way as in Example 3, except that the materials shown in Table 1 were used for the first substrate.

Figure 5:
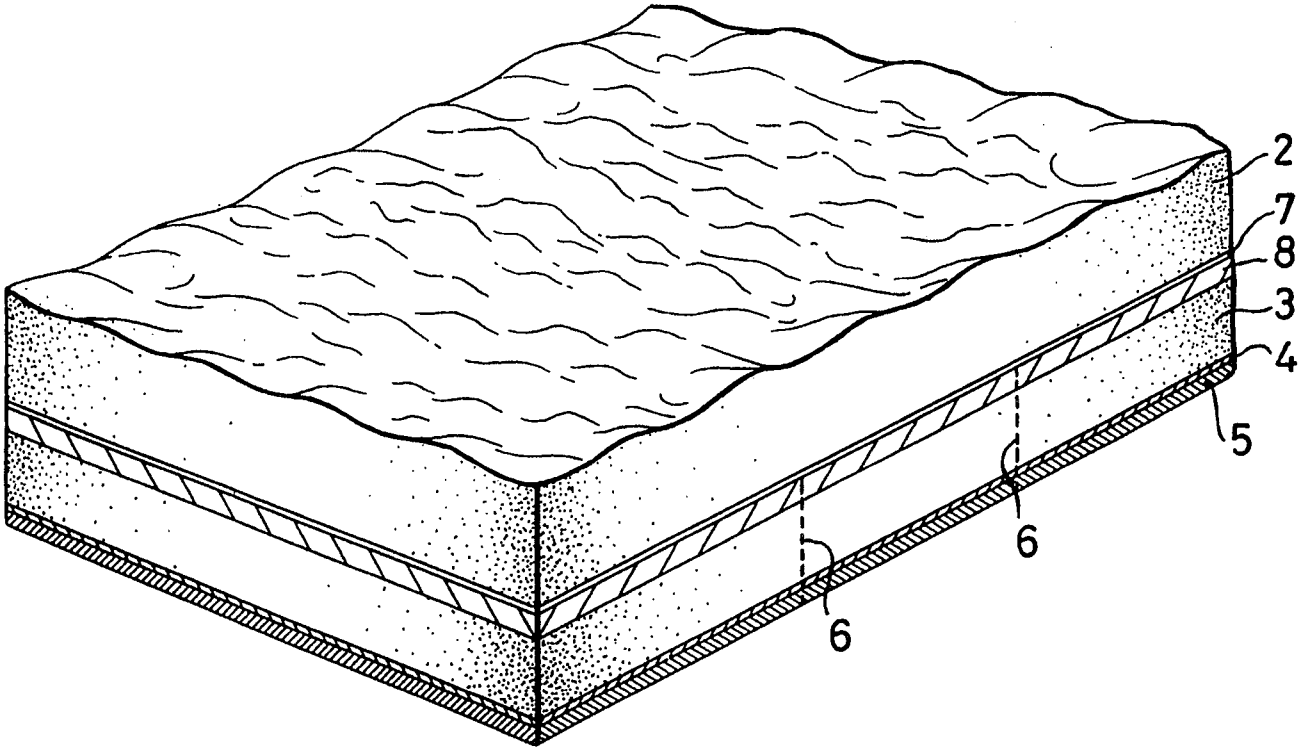
FIG. 5 is a schematic perspective view showing a third embodiment of a heat transfer sheet according to the present invention.
Figure 6:
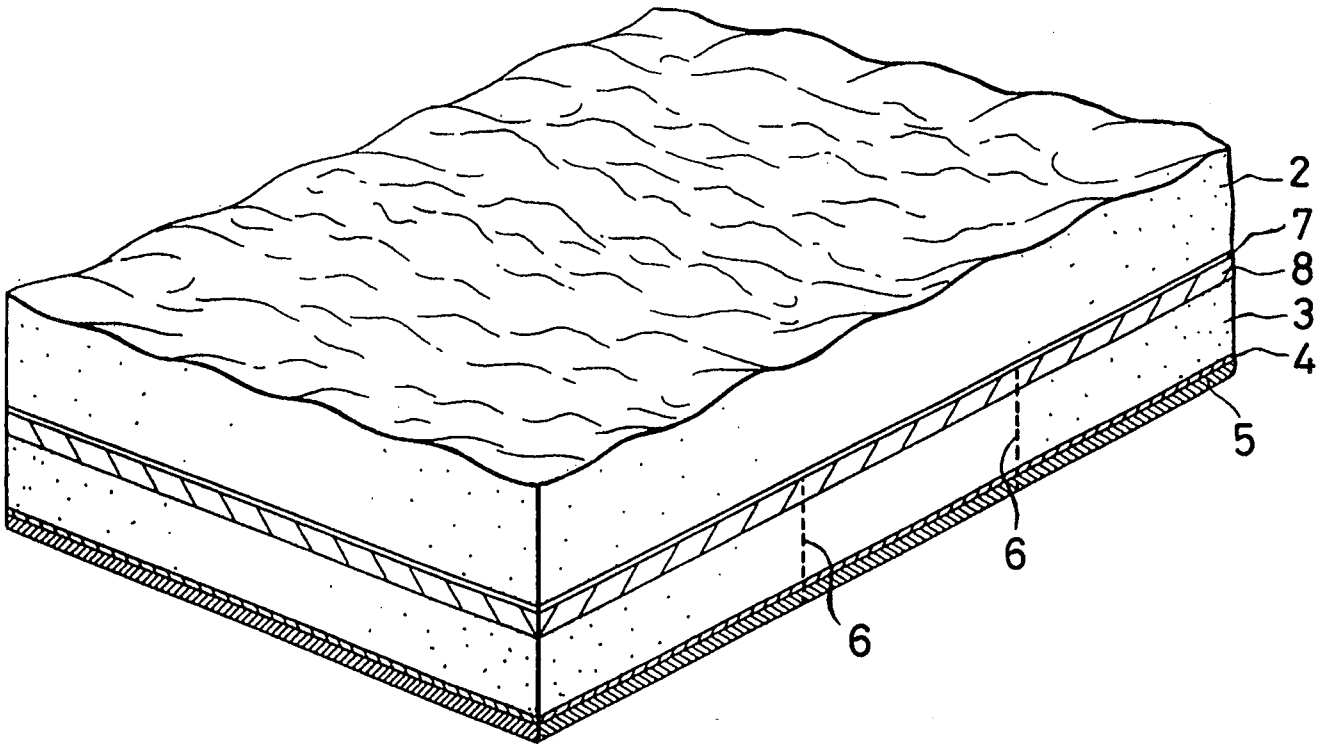
FIG. 6 is a schematic perspective view showing a fourth embodiment of a heat transfer sheet according to the present invention.

The heat transfer sheets of Example 4 using crepe paper and Example 5 using an extensible kraft paper can be shown schematically, for example, as in FIG. 5. The heat transfer sheet of Example 6 using embossed paper can be shown schematically, for example, as in FIG. 6.

TABLE 1

| | Item | | | |
|---|---|---|---|---|
| | Ex. 4 | Ex. 5 | Ex. 6 | Ex. 7 |
| Material | Crepe paper | Extensible kraft paper | Embossed paper | Nonwoven fabric |
| Basis weight ($g/m^2$) | 80 | 73 | 115 | 60 |
| Air Resistance (seconds) | 3 | 23 | 2,000 | 0 |
| Smoothness | | | | |
| Front (sec.) | 0 | 8 | 2 | 0 |
| Back (sec.) | 0 | 14 | 5 | 0 |
| Nature of material | Air permeable rough surface | Slightly air permeable, slightly rough surface | Poor air permeability, rough surface | High air permeability, cloth-like |
| Barrier for peel layer | PE 17 μm | PE 17 μm | PE 17 μm | PE 17 μm |
| Peel treatment | same as in Ex. 3 | same as in Ex. 3 | same as in Ex. 3 | same as in Ex. 3 |
| Deaeration time (sec.) | 30 | 45 | 45 | 30 |
| Pressure reached (gauge pressure) | 600 mmHg | 600 mmHg | 600 mmHg | 600 mmHg |
| Heating conditions | 110° C. × 5 min. | 110° C. × 5 min. | 110° C. × 5 min. | 110° C. × 5 min. |

The resulting heat transfer sheets (Examples 4 through 7) were all excellent in suitability for cutting, the peeling properties of the unnecessary portions of the thermally transferable layer, including the second substrate, as well as in the ease of deaeration and heat transfer properties in the H.V.A.

Figure 7:
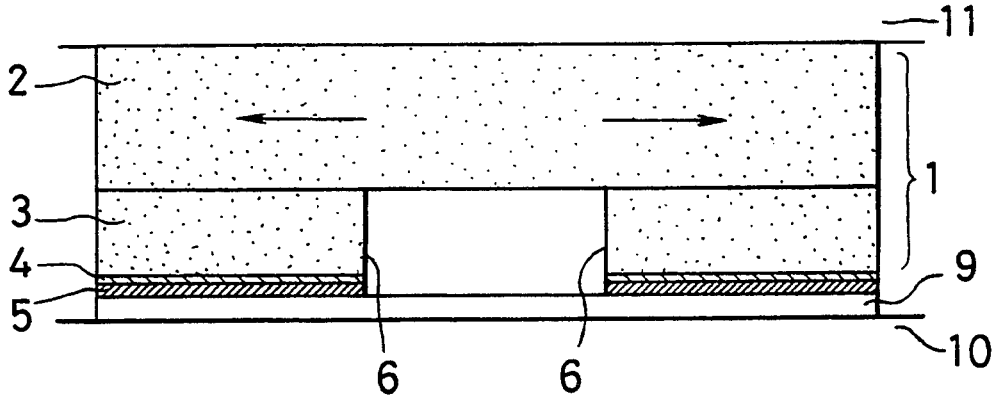
FIG. 7 is a schematic cross-sectional view showing a state in which an embodiment of a heat transfer sheet according to the present invention is placed on a transfer table of H.V.A. after peeling off a second substrate and a thermally transferable layer therefrom according to shapes of letters, and in which the deaeration is performed prior to heat transfer using the H.V.A.

Next, the deaeration action during the heat transfer operation for the heat transfer sheet of the present invention using the H.V.A. will be described with reference to FIG. 7. In this drawing, the reference numeral 9 denotes a transfer substance. The transfer substance 9 is placed on a transfer table 10 of the H.V.A., and a heat transfer sheet of the construction illustrated in FIG. 1 is placed thereon with a thermally transferable layer 5 facing downward. The heat transfer sheet is covered with a framed rubber sheet 11, whereafter air existing between the transfer table 10 and the rubber sheet 11 is removed by a vacuum pump (not shown). Since the first substrate 2 of the heat transfer sheet is highly air permeable, that air moves in the directions of arrows in FIG. 7 and discharges to the surroundings of the heat transfer sheet. The movement of air, i.e., deaeration, is performed uniformly and rapidly throughout the heat transfer sheet. Thus, no wrinkles are formed on the heat transfer sheet, and no air reservoir remains between the heat transfer sheet and the rubber sheet. This deaeration action permits the rubber sheet to conform to the shape of the heat transfer sheet, enabling heat transfer. Heating by a heating device (not shown) results in heat transfer onto the transfer substance 9.

As described above, the heat transfer sheet of the present invention uses the first substrate having a rough surface and/or comprising an air permeable material. Thus, the heat transfer sheet exhibits satisfactory deaeration and heat transfer properties, without the need to use a porous material as a third material which has been necessary with conventional heat transfer sheets. Consequently, when the heat transfer sheet of the present invention is subjected to heat transfer using the H.V.A., it is not necessary to cover the heat transfer sheet with a porous material as a third material, thus making it possible to increase the operating efficiency markedly.

Furthermore, the heat transfer sheet of the present invention has the first substrate and the second substrate. Hence, even if the thermally transferable layer is thin, desired letters, symbols or designs can be prepared easily by use of an automatic cutting system. Therefore, the use of the heat transfer sheet according to the present invention makes the printing of designs unnecessary, and enables arbitrary designs to be prepared whenever necessary and obtained as a heat transferred pattern.

The present invention has been described in detail with respect to preferred embodiments, and it will now be that changes and modifications may be made without departing from the invention in its broader aspects, and it is the intention, therefore, in the appended claims to cover all such changes and modifications as fall within the true spirit of the invention.

What is claimed is:

1. A heat transfer sheet, comprising a first substrate, a second substrate being peelably integrated with said first substrate, and a thermally transferable layer being formed on said second substrate integrated with said first substrate, wherein at least said first substrate is air permeable and has a low air resistance.

2. A heat transfer sheet as claimed in claim 1, further comprising a releasing layer being arranged between said second substrate and said thermally transferable layer, said releasing layer separating said second substrate from said thermally transferable layer during heat vacuum application of said thermally transferable layer as information onto a transfer surface.

3. A heat transfer sheet, comprising a first substrate, a second substrate being peelably integrated with said first substrate, and a thermally transferable layer being formed on said second substrate integrated with said first substrate, wherein at least said first substrate has a rough surface, thereby enhancing deaeration of said heat transfer sheet during heat vacuum application of said thermally transferable layer onto a transfer surface.

4. A heat transfer sheet as claimed in claim 3, further comprising a releasing layer being arranged between said second substrate and said thermally transferable layer, said releasing layer separating said second substrate from said thermally transferable layer during said heat vacuum application of said thermally transferable layer as information onto said transfer surface.

5. A heat transfer sheet, comprising a first substrate, a second substrate being peelably integrated with said first substrate, and a thermally transferable layer being formed on said second substrate integrated with said first substrate, wherein at least said first substrate is air permeable and has a low air resistance, and wherein said at least first substrate has a rough surface.

6. A heat transfer sheet as claimed in claim 5, further comprising a releasing layer being arranged between said second substrate and said thermally transferable layer, said releasing layer separating said second substrate from said thermally transferable layer during heat vacuum application of said thermally transferable layer as information onto a transfer surface.

* * * * *